US007849866B1

(12) United States Patent
Mangum

(10) Patent No.: US 7,849,866 B1
(45) Date of Patent: Dec. 14, 2010

(54) PORTABLE PRIVACY SHELTER

(75) Inventor: Stephen P. Mangum, 31990 Eureka Cir., Winchester, CA (US) 92596

(73) Assignee: Stephen P. Mangum, Canyon Lake, CA (US)

( * ) Notice: Subject to any disclaimer, the term of this patent is extended or adjusted under 35 U.S.C. 154(b) by 426 days.

(21) Appl. No.: 11/499,510

(22) Filed: Aug. 3, 2006

(51) Int. Cl.
*E04H 15/02* (2006.01)
*A47K 11/04* (2006.01)

(52) U.S. Cl. ..... 135/96; 135/90; 135/126; 135/117; 4/476; 297/16.2

(58) Field of Classification Search ..... 135/87, 135/90, 91, 93, 96, 117, 119, 901, 902; 4/430, 4/460, 463, 483, 484, 476; 297/462, 440.1, 297/440.12, 16.1, 16.2, 17
See application file for complete search history.

(56) References Cited

U.S. PATENT DOCUMENTS

| | | | | | |
|---|---|---|---|---|---|
| 703,690 | A | * | 7/1902 | Young | 297/44 |
| 857,914 | A | * | 6/1907 | Weber | 297/354.1 |
| 1,163,263 | A | * | 12/1915 | Rudduck | 297/36 |
| 1,419,947 | A | * | 6/1922 | Schouten | 297/17 |
| 1,538,311 | A | * | 5/1925 | Anticknap | 135/140 |
| 1,567,484 | A | * | 12/1925 | Beard | 248/439 |
| 1,575,131 | A | * | 3/1926 | Schumacher | 4/460 |
| 1,577,595 | A | * | 3/1926 | Smith | 4/460 |
| 1,599,798 | A | | 9/1926 | Stockton | |
| 1,803,626 | A | | 5/1931 | Lasley | |
| 2,139,579 | A | | 6/1937 | Dier | |
| 3,288,157 | A | | 11/1966 | Szkolny | |
| 3,540,170 | A | * | 11/1970 | Flowers | 52/2.19 |
| 4,224,754 | A | * | 9/1980 | Derryberry | 43/1 |
| 4,825,578 | A | | 5/1989 | Robinson | |
| 4,974,265 | A | | 12/1990 | Maggio | |
| 4,979,242 | A | | 12/1990 | Maggio | |
| 5,005,223 | A | | 4/1991 | Greenwood | |
| 5,301,706 | A | * | 4/1994 | Jones | 135/125 |
| 5,385,164 | A | | 1/1995 | Sauter | |
| 5,430,980 | A | | 7/1995 | Ferrier | |
| 5,528,849 | A | | 6/1996 | Plinta | |
| 5,890,507 | A | * | 4/1999 | Hinsperger | 135/96 |
| 5,937,452 | A | * | 8/1999 | Brewer | 4/460 |
| 5,974,597 | A | * | 11/1999 | Conwell | 4/432 |
| 6,088,953 | A | * | 7/2000 | Morgan | 47/31 |
| 6,463,599 | B1 | * | 10/2002 | Perthu | 4/599 |
| 6,672,322 | B1 | * | 1/2004 | Littlefield | 135/90 |
| 6,718,565 | B1 | * | 4/2004 | Cruz | 4/476 |
| 2005/0034748 | A1 | | 2/2005 | Gadd | |

FOREIGN PATENT DOCUMENTS

| | | | |
|---|---|---|---|
| FR | 2829680 | A1 * | 3/2003 |

* cited by examiner

*Primary Examiner*—Winnie Yip

(57) ABSTRACT

The present invention may be used for privacy of individuals when changing clothes, for toilet privacy or other user privacy needs. A privacy shelter may have a wall that may be of generally tubular shape and may have a lower portion that may be an opaque, flexible material and an upper portion that is partially transparent. A top may be generally circular and flat in shape and may be attached at a peripheral edge to a top edge of the wall. A first ring may be attached to the top edge; a second ring may be attached interior to the wall adjacent a bottom edge; and a third ring may be attached interior to the wall intermediate the top edge and the bottom edge. A toilet stool or toilet chair may be disposed in the privacy shelter.

20 Claims, 3 Drawing Sheets

PORTABLE PRIVACY SHELTER

BACKGROUND OF THE INVENTION

This invention relates to devices that may be used as privacy shelter by persons for changing clothes, for toilet privacy as an example in an outdoor environment, or for other user privacy needs. The new device may have a generally tubular wall with an attached generally circular top, an upper portion that may be a mesh material and two or more rings for wall shaping. A toilet stool or toilet chair may also be transported with the privacy shelter.

Dressing shelters or portable dressing rooms that may be tubular, rectangular or other shape may be known. These devices may have vertical rods or coiled springs to support the shelter in an upright position. The shelters may be open at the top or have a hat to place on a users head to support the shelter wall that is opaque in a deployed manner. The shelter wall may have a window panel therein for the user to see through and to aid in ventilating the interior of the shelter.

Other generally tubular camouflage or weather shelter devices for individual use may exist, for example, for use by persons who may be hunting game. These structures may be supported by straps positioned to rest on a user's shoulders or by attachment, using a line or rope, to a tree branch or other overhead structure. While these devices may use a netting element as part of the enclosure, it may not be positioned adjacent a closed top for support on the head of a user.

SUMMARY OF THE INVENTION

The present invention is directed to devices for privacy of individuals when changing clothes, for toilet privacy or other user privacy needs. A privacy shelter may have a wall that may be of generally tubular shape and may have a lower portion that may be an opaque, flexible material and an upper portion that is partially transparent. A top may be generally circular and flat in shape and may be attached at a peripheral edge to a top edge of the wall. A first ring may be attached to the top edge; a second ring may be attached interior to the wall adjacent a bottom edge; and a third ring may be attached interior to the wall intermediate the top edge and the bottom edge. A toilet stool or toilet chair may be disposed in the privacy shelter.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
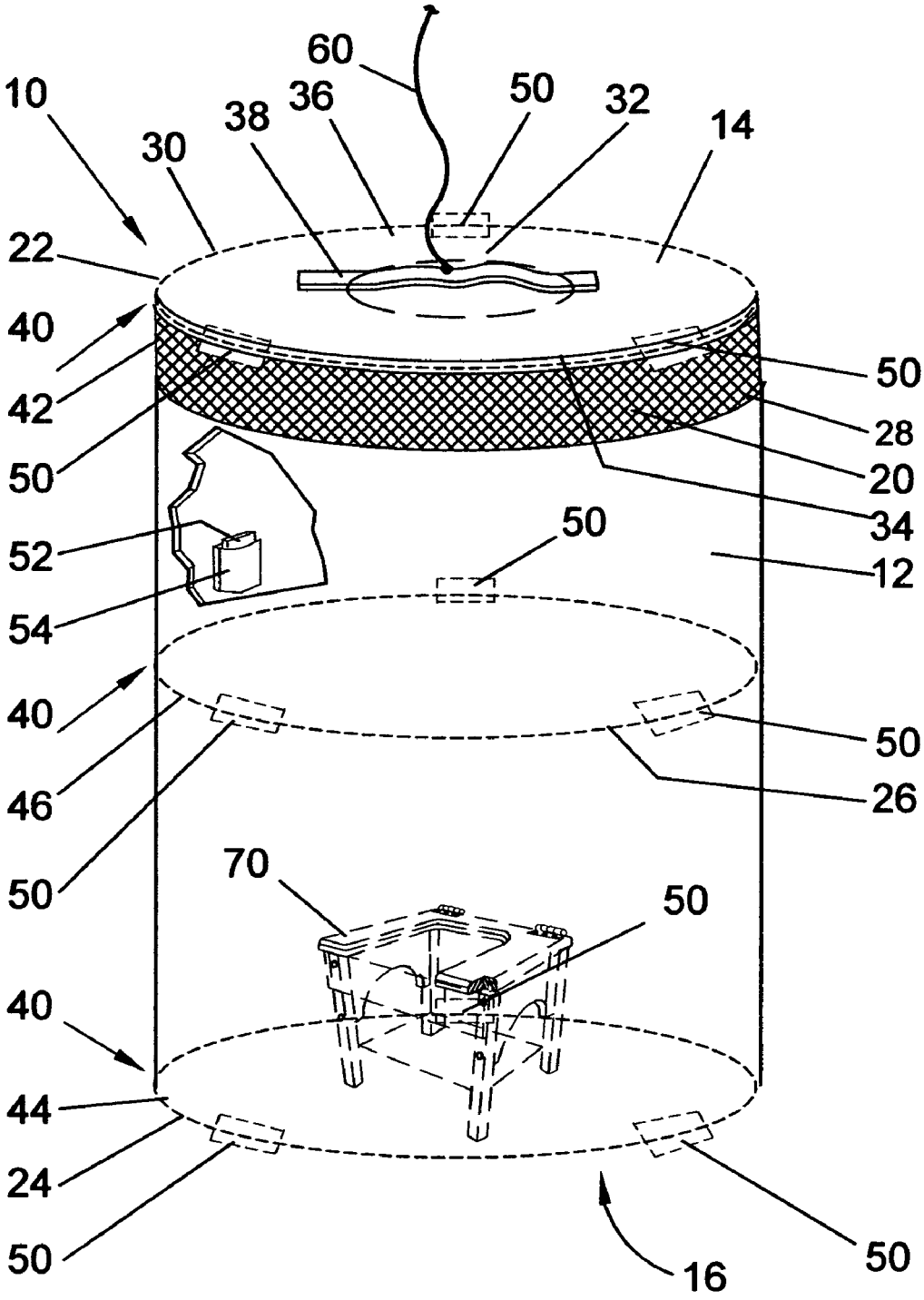
FIG. 1 illustrates a perspective elevation view of a privacy shelter according to an embodiment of the invention.
Figure 2:
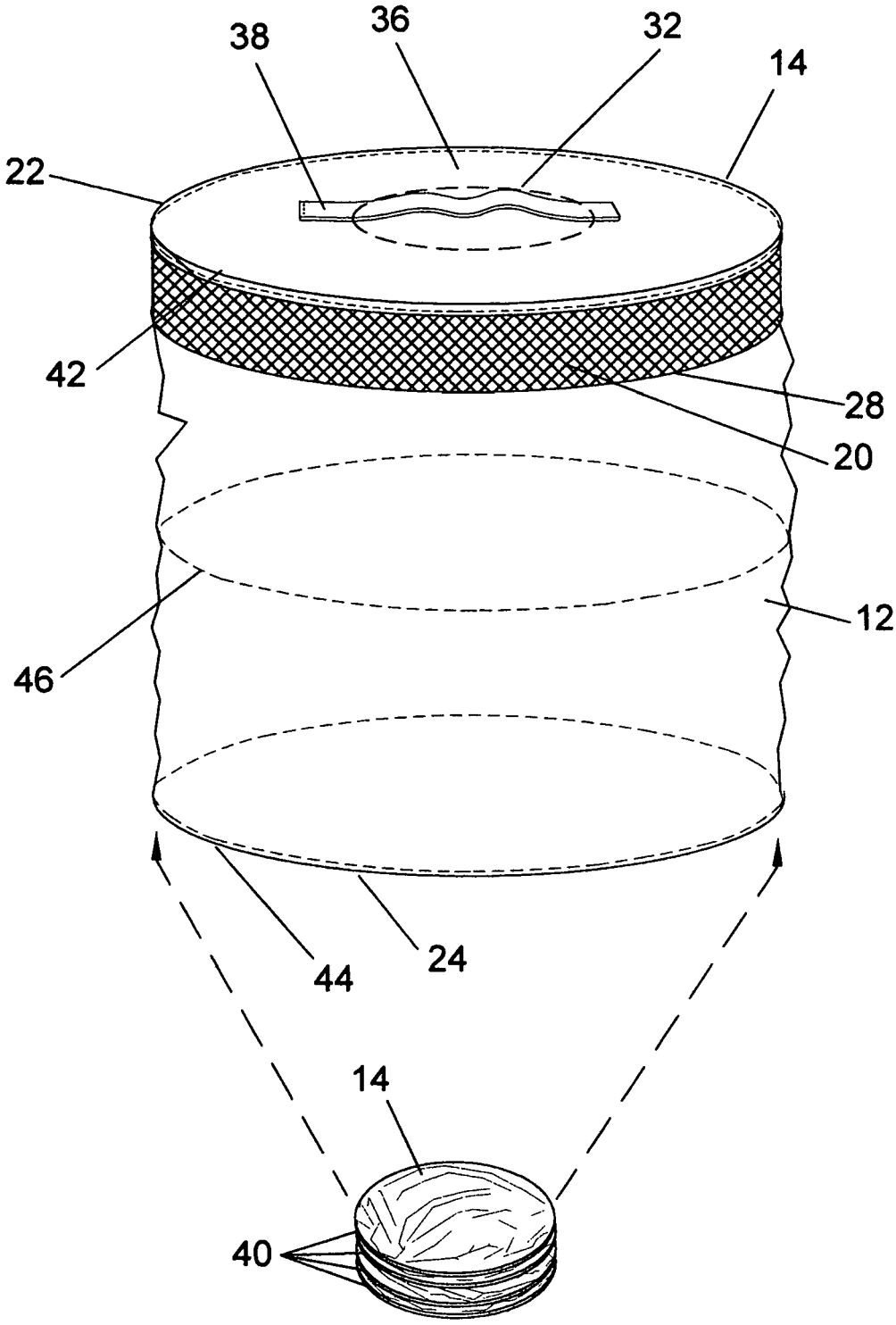
FIG. 2 illustrates a perspective view of a folded and a partially expanded privacy shelter according to an embodiment of the invention.
Figure 3:
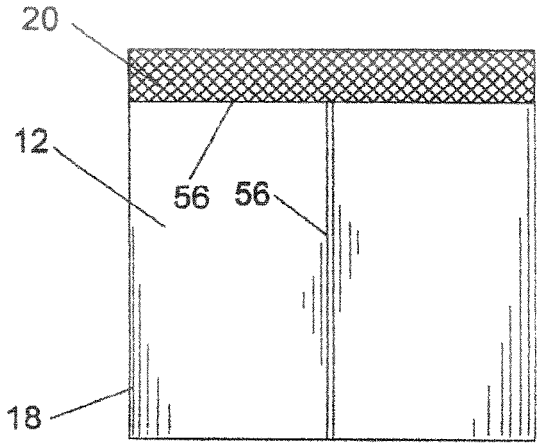
FIG. 3 illustrates a wall of a privacy shelter laid open according to an embodiment of the invention.

Referring to FIGS. 1 through 3, a privacy shelter 10 that may be portable and easily erected may be of generally tubular form having a wall 12, a top 14 and an open bottom 16. The wall 12 may have a generally opaque lower portion 18 attached at an upper edge 28 to a mesh material, net, screen or like open texture material as an upper portion 20. The upper portion 20 may allow a user to look outside of the shelter 10 and may serve as a vent for the shelter 10. The upper portion 20 may have a width of 18 inches or less although 3 inches or less may be preferable for purposes of privacy. The privacy shelter 10 may be useful for changing clothes, for toilet privacy or for other privacy needs.

The top 14 may be of generally circular flat form and may be attached at a peripheral edge 30 to a top edge 22 of the wall 12. There may be a friction pad 32 attached to the interior 34 of the top 14. When the shelter 10 may be positioned on a user, the friction pad 32 may serve to keep the top 14 positioned on the user's head or when a user may hold the top 14 above their head with a hand to change clothes for example, the friction pad 32 may aid in stabilizing the shelter 10. The friction pad 32 may be a slip resistant material, for example, roughened material, rubber-like material and the like. The top 14 may also have a strap 38 attached to the exterior surface 36. The strap 38 may be used to hold the shelter 10 for use by a person or the shelter 10 may be hung from an object, for example, a tree limb. A string 60 attached to the strap 38 or top 14 may also be used for attachment to a support to suspend the shelter 10.

There may be three rings 40 attached interior to the wall 12. A first ring 42 may be attached at a top edge 22 or it may be attached to the interior surface 34 of the top 14 adjacent the peripheral edge 30. A second ring 44 may be attached at a bottom edge 24 and a third ring 46 may be attached intermediate the first ring 42 and the second ring 44. The rings 40 may be attached using attachment straps 50 that may be hook and loop material, that may have snaps, or that may use other fastener elements to secure the attachment straps 50 around the rings 40.

The rings 40 or hoops may be constructed of any resilient material that may be twisted and may return to a general hoop shape when not restrained. This material structure may allow each ring 40 to be twisted upon it self to be approximately ⅓ to ¼ the diameter of an open ring 40, as best viewed in FIG. 2. This may allow for compact storage and transport of the privacy shelter 10. The rings 40 may be removed from the interior of the wall 12 by unfastening the attachment straps 50. This may allow for ease of cleaning, for example, washing of the wall 12 and top 14. The attachment straps 50 may be continuous material sewn to the wall 12 or top 14, or there may be multiple separate straps 50 at each of the top edge 22, bottom edge 24 and intermediate location 26, for example, three attachment straps 50 at each of the 22, 24, 26 locations may serve to maintain the rings 40 in position.

The wall 12 may be formed of two generally rectangular pieces of flexible, durable and lightweight material, for example, nylon, for the lower portion 18 and a strip of mesh material for the upper portion 20. The wall 12 elements and top 14 may be attached by sewing using interior seams 56 or by other suitable fastening methods.

There may be a pouch or pocket 52 attached on an interior portion 54 of the wall 12 for use in storing toilet paper or other objects. There may be a carry bag (not shown) for storage and carry of the privacy shelter 10 that may also allow carrying a toilet stool 70, shovel or other objects.

Figure 4:
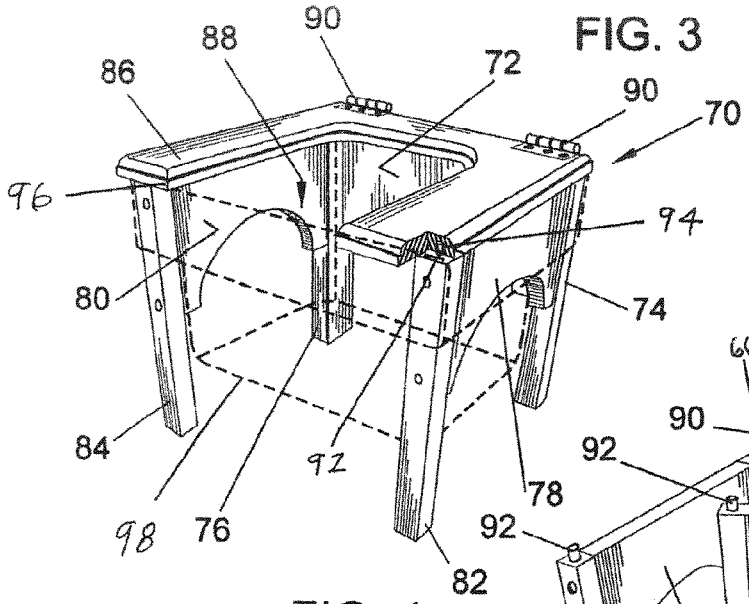
FIG. 4 illustrates a perspective elevation view of a toilet stool according to an embodiment of the invention.
Figure 5:
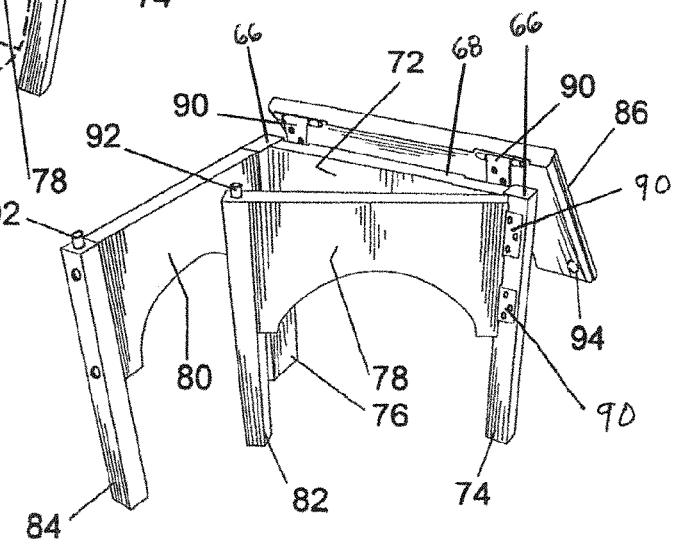
FIG. 5 illustrates a perspective view of a toilet stool partially folded according to an embodiment of the invention.

Referring to FIGS. 4 and 5, a toilet stool 70 or toilet chair may be foldable for storage and transported with the privacy shelter 10. The stool 70 may be constructed of lightweight, durable material, such as, rigid plastic, composites or the like. A back support 72 may have a first back leg 74 and second back leg 76 attached. A first side 78 having a first front leg 82 may be rotatably attached by hinges 90 to the first back leg 74. A second side 80 having a second front leg 84 may be rotatably attached by hinges to the second back leg 76.

The first back leg 74 or second back leg 76 may extend forwardly or have a width to allow folding of one back leg 74, 76 against the other back leg 74, 76. FIG. 5 illustrates a widened second back leg 76 such that the first side 78 may be folded against the back support 72 and then the second side 80 may be folded against the first side 78.

There may be a seat 86 rotatably attached by hinges 90 to the back support 72 for folding the seat 86 against the back support 72 against the back side or side opposite the folded sides 78, 80. The top edge 68 of the back support 72 may be positioned adjacent a top end 66 of each back leg 74, 76. The seat 86 may be rotated to rest on and be supported by the sides 78, 80 for use.

The seat 86 may have an opening 88 that may be open at the front edge 96 of the seat 86. A user may sit on the stool 70 while in the shelter 10 to use the system as a portable toilet. A bag 98 made of plastic or other suitable material may be positioned on the back support 72 and sides 78, 80 with the seat 86 positioned for use to retain the bag 98. The front legs 82, 84 may have dowels 92 or pins positioned for insertion in holes 94 in the seat 86 to aid in stabilizing the stool 70 for use.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for user privacy comprising:

a wall of generally tubular shape having a lower portion that is an opaque, flexible material and an upper portion that is an open texture material;

a top of generally circular, flat shape attached at a peripheral edge to a top edge of said wall;

a friction pad attached to an interior central portion of the top, wherein the friction pad is for stabilizing the device upon a user;

a first ring attached interior to said wall adjacent said top edge; and a second ring attached interior to said wall adjacent a bottom edge.

2. The device as in claim 1 wherein a third ring is attached interior to said wall intermediate said top edge and said bottom edge.

3. The device as in claim 2 wherein said first ring, said second ring and said third ring are attached to said wall by a plurality of attachment straps.

4. The device as in claim 3 wherein said attachment straps are each closed by a hook and loop fastener.

5. The device as in claim 2 wherein said first ring, said second ring and said third ring are formed of a resilient, twistable material.

6. The device as in claim 1 wherein said first ring is attached to an interior surface of said top.

7. The device as in claim 1 wherein the friction pad is comprised of a slip-resistant material.

8. The device as in claim 1 wherein a strap is attached to an exterior surface of said top.

9. The device as in claim 1 wherein a pocket is attached to an interior portion of said wall.

10. The device as in claim 1 wherein:

said lower portion of said wall is formed from two generally rectangular pieces of material sewn together at two mating edges to form two interior generally vertical seams; and said upper portion of said wall is a rectangular mesh material sewn along one edge to an upper edge of said lower portion to form a mating interior seam.

11. The device as in claim 1 wherein said lower portion is constructed of nylon.

12. The device as in claim 1 wherein said upper portion is approximately 3 inches wide.

13. The device as in claim 1 wherein a toilet stool is disposed in said device and said toilet stool comprising:

a back support with a first back leg and a second back leg attached with a top edge of said back support disposed adjacent to a top end of said first back leg and said second back leg, wherein said top edge of said back support does not exceed the height of the first and second back leg;

a first side having a first front leg rotatably attached to said first back leg, wherein said first side laterally rotates ninety degrees away from a front side of said back support so said first front leg and said first back leg are aligned;

a second side having a second front leg rotatably attached to said second back leg, wherein said second side laterally rotates ninety degrees away from said front side of said back support so said second front leg and said second back leg are aligned; and a seat rotatably attached to said back support, wherein said seat lies against a back side of said back support and rotates about said top edge of said back support in order to rest on said first side and said second side when said first side and said second side are fully rotated away from said front side of said back support, wherein said seat has an opening therein.

14. A toilet stool comprising:

a back support with a first back leg and a second back leg attached with a top edge of said back support disposed adjacent to a top end of said first back leg and said second back leg, wherein said top edge of said back support does not exceed the height of the first and second back leg;

a first side having a first front leg rotatably attached to said first back leg, wherein said first side laterally rotates ninety degrees away from a front side of said back support so said first front leg and said first back leg are aligned;

a second side having a second front leg rotatably attached to said second back leg, wherein said second side laterally rotates ninety degrees away from said front side of said back support so said second front leg and said second back leg are aligned; and a seat rotatably attached to said back support, wherein said seat lies against a back side of said back support and rotates about said top edge of said back support in order to rest on said first side and said second side when said first side and said second side are fully rotated away from said front side of said back support, wherein said seat has an opening therein.

15. The toilet stool as in claim 14 wherein said first front leg, said second front leg and said seat are each rotatably attached by a hinge.

16. The toilet stool as in claim 14 wherein said first front leg and said second front leg each have a pin attached and positioned for insertion in said seat having a hole therein disposed for receipt of said pin when said seat is rotated to be positioned on said first side and said second side.

17. The toilet stool as in claim 14 wherein one of said first back leg and said second back leg is extended forwardly the approximate width of one of said first side and said second side.

18. The toilet stool as in claim 14 wherein a bag is disposed on said back support, said first side and said second side under said seat.

19. The toilet stool as in claim 15, wherein each hinge is an extension of said back support, said front leg, said second leg, and said seat and not a separate affixed hinge.

20. The toilet stool of claim 14, wherein said seat comprises a groove running along peripheral edges of said seat in order to securely be coupled to a raised rail of said first side and said second side when said seat is resting on said first side and said second side.

* * * * *